United States Patent [19]

Tanaka et al.

[11] 3,930,869

[45] Jan. 6, 1976

[54] PHOTOGRAPHIC SILVER HALIDE PHOTOSENSITIVE MATERIALS

[75] Inventors: Akira Tanaka; Shoichi Horii; Seigo Ebato; Mamoru Sekido; Shoji Oka, all of Nagaokakyo, Japan

[73] Assignee: Mitsubishi Paper Mills, Ltd., Japan

[22] Filed: Jan. 4, 1974

[21] Appl. No.: 430,624

[30] Foreign Application Priority Data

Jan. 12, 1973 Japan ..... 48-6466

[52] U.S. Cl. ..... 96/123; 96/127

[51] Int. Cl.[2] ..... G03C 1/10

[58] Field of Search ..... 96/127, 139, 140, 123

[56] References Cited

UNITED STATES PATENTS

| | | | |
|---|---|---|---|
| 2,635,961 | 4/1953 | Carroll | 96/127 |
| 2,656,351 | 10/1953 | Aubert et al. | 96/127 |
| 3,719,495 | 3/1973 | Lea | 96/127 |

*Primary Examiner*—J. Travis Brown

*Attorney, Agent, or Firm*—Cushman, Darby & Cushman

[57] ABSTRACT

Double merocyanine compounds having the following general formula as referred to hereinafter are useful as sensitizing dyes in siliver halide photosensitive materials.

8 Claims, No Drawings

PHOTOGRAPHIC SILVER HALIDE PHOTOSENSITIVE MATERIALS

BACKGROUND OF THE INVENTION

1. Field of the Invention

The present invention relates to a photographic silver halide photosensitive material. More particularly, it relates to a photographic silver halide photosensitive material containing double merocyanine type sensitizing dyes having an improved solubility in organic solvents.

2. Description of the Prior Art

It has been well known that use of double merocyanine sensitizing dyes in a photographic silver halide photosensitive material can result in spectral sensitization. However, the serious defect in using double merocyanine sensitizing dye is its poor solubility. That is, with use of said dye, not only the dye solutions of desired concentration in organic solvents such as lower alcohol and acetone which are freely miscible with water cannot be obtained, but also the dye solutions even in organic solvents such as dimethylformamide cannot be obtained in satisfactory concentration. Therefore, in order to use the dye in an amount sufficient for spectral sensitization, it is necessary to use a large amount of dilute dye solution. As the result, it has often happened that properties of the photosensitive materials (such as mechanical strength of photosensitive film, adhesion between photosensitive layer and support, etc.) and photographic characteristics are unfavorably affected due to the use of a large amount of organic solvent.

SUMMARY OF THE INVENTION

The object of the present invention is to provide a photographic silver halide photosensitive material containing sensitizing dyes which overcome said defect in the conventional double merocyanine sensitizing dyes and have improved solubility in organic solvents.

DESCRIPTION OF THE PREFERRED EMBODIMENTS

The double merocyanine dyes according to the invention have the following general formula (I)

acid group, an alkenyl group or a substituted aryl group and $R_3$ represents a lower alkyl group of not more than 5 carbon atoms, a substituted lower alkyl group having no sulfonic acid group and carboxylic acid group, an alkyl group or a substituted aryl group and all $R_1$, $R_2$ and $R_3$ cannot be a lower alkyl at the same time).

Solubility of the double merocyanine sensitizing dyes in organic solvents of the present invention having the above general formula in dimethylformamide is conspicuously higher than that of those where $R_1$, $R_2$ and $R_3$ are all lower alkyl groups. Furthermore, the solubility of the dyes of the present invention in organic solvents such as ethanol, acetone, etc. is also increased to such an extent as practically required for addition to emulsion. As the result, amount of organic solvent added to silver halide emulsion can be extremely decreased. Therefore, no unfavorable effect is given on properties of photographic photosensitive material (such as mechanical strength of film and adhesion between photosensitive layer and support) and photographic characteristics such as color stain caused by the sensitizing dye remaining after processing and desensitization occuring with lapse of time, namely, from preparation of the dye solution to addition thereof to silver halide emulsion. Furthermore, the dyes of the present invention have excellent photographic characteristics without increase in fog and desensitization even with lapse of time under severe conditions after application to a support and thus the dyes of the present invention are markedly effective as spectral sensitizer. Moreover, the sensitizing dyes used in the present invention exhibit substantially no reduction in sensitizing efficiency when used in combination with the same kind of dyes or dyes different from those in the present invention as compared with the case of single use. Rather, in some special combination, the sensitizing ability is increased. Because of these advantages, the present invention if extremely excellent as spectral sensitizing method of photographic emulsions where two or more of dyes are often used in combination.

In the general formula (I), the substituents in the substituted lower alkyl are preferably a lower alkoxy of not more than 5 carbon atoms, a lower alkoxycarbonyl of not more than 5 carbon atoms and an aralkyl. The substituents in the substituted aryl group are preferably

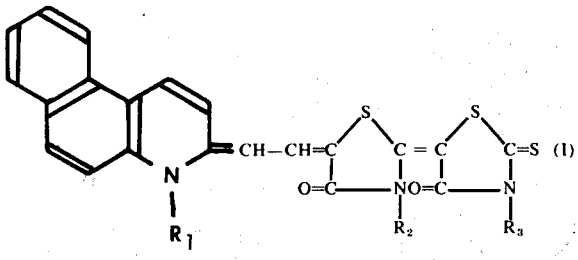

(wherein $R_1$ represents a lower alkyl group of not more than 5 carbon atoms, a substituted lower alkyl group having no sulfonic acid and carboxylic acid group or an alkenyl group, $R_2$ represents a lower alkyl group of not more than 5 carbon atoms, a substituted lower alkyl group having no sulfonic acid group and carboxylic a lower alkyl of not more than 5 carbon atoms, a lower alkoxy of not more than 5 carbon atoms and a lower alkoxycarbonyl of not more than 5 carbon atoms.

Representatives of the sensitizing dyes having said general formula (I) are as follows:

-continued
Compound No. 1
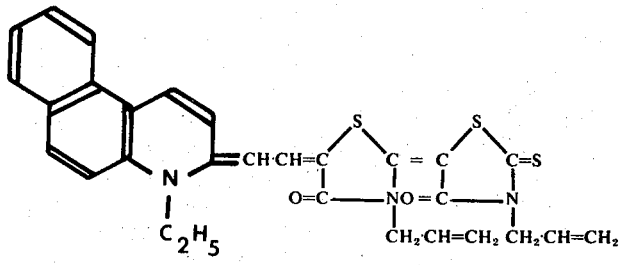
m.p. 275.0–6.5°C
Acetone absλ max 623.584 mμ
Compound No. 2
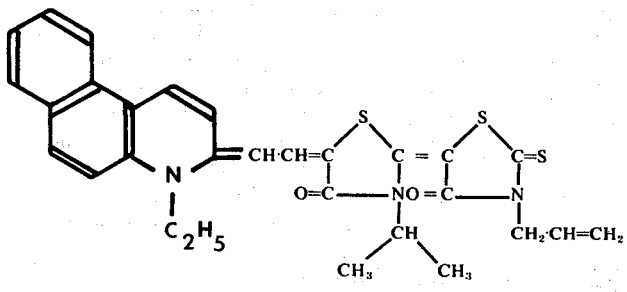
m.p. 259.0–262.0°C
Acetone absλ max 628.588 mμ
Compound No. 3
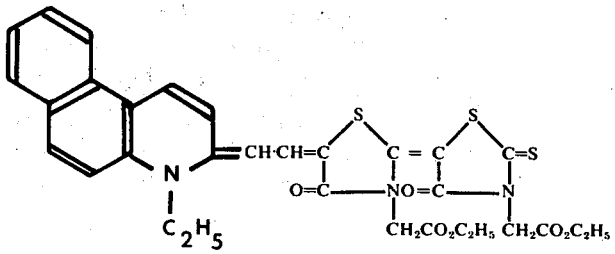
m.p. 274.0–5.0°C
Acetone absλ max 622.582 mμ
Compound No. 4
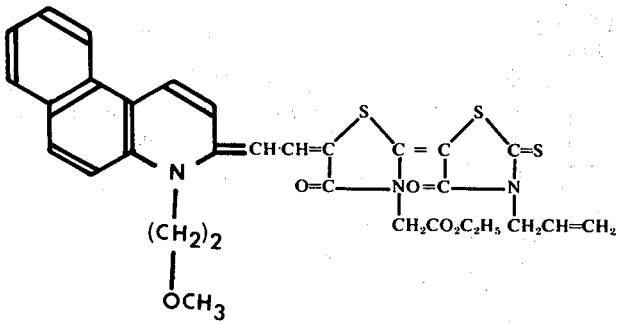
m.p. 276.0°C (dec)
Acetone absλ max 618.580 mμ
Compound No. 5
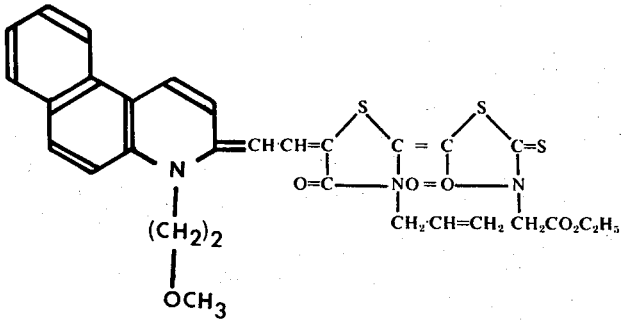
m.p. 282.0°C (dec)
Acetone absλ max 622.588 mμ

-continued
Compound No. 6
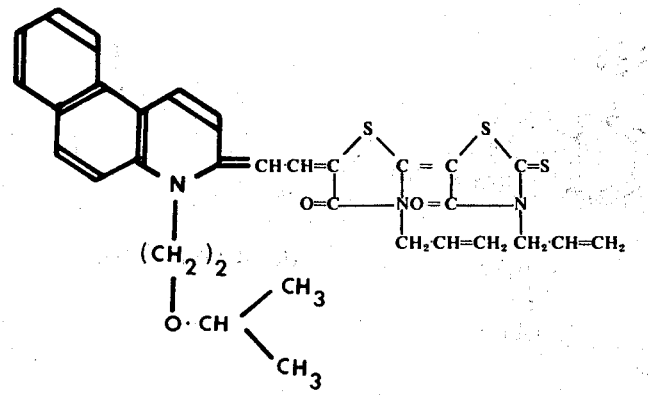
m.p. 231.0–3.0°C
Acetone absλ max 623.588 mμ
Compound No. 7
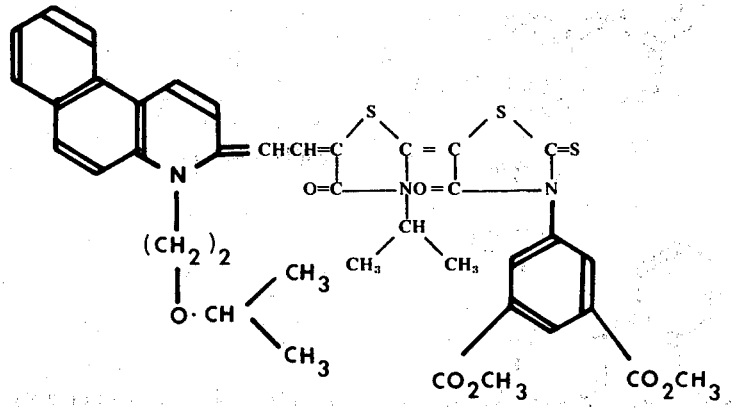
m.p. 278.0–280.0°C
Acetone absλ max 628.590 mμ
Compound No. 8
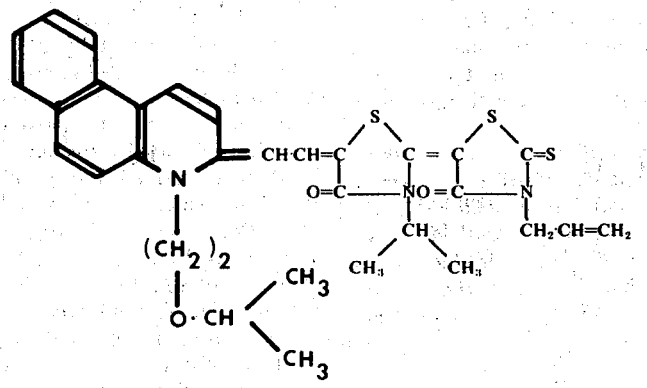
m.p. 276.0–7.0°C
Acetone absλ max 626.589 mμ
Compound No. 9
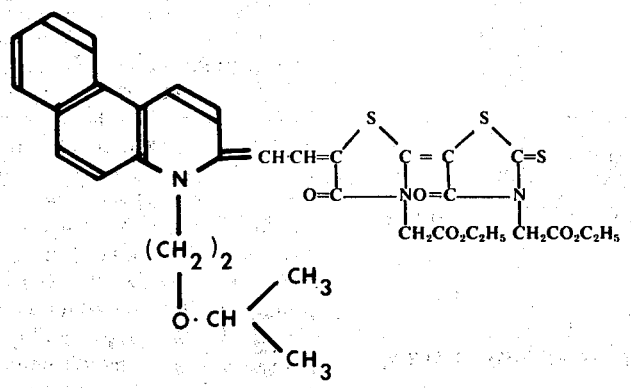
m.p. 239.0–240.0°C
Acetone absλ max 625.585 mμ

-continued

Compound No. 10

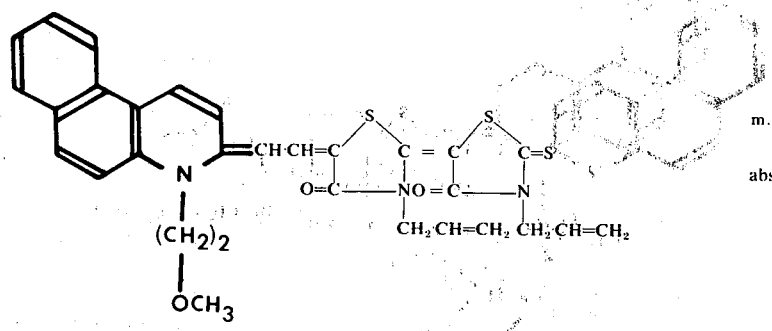

m.p. 281.0°C (dec)
Acetone
absλ max
626.586 mμ

Compound No. 11

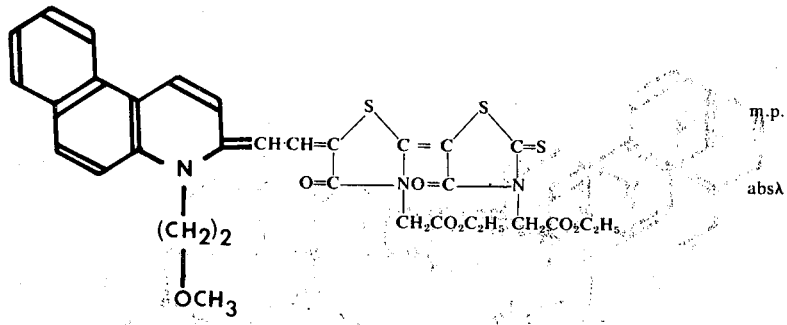

m.p. 281.0–3.0°C
Acetone
absλ max
624.585 mμ

The double merocyamine sensitizing dyes used in the present invention are not limited to the representatives enumerated above and those which contain said chemical structure may be used. Furthermore, if necessary, two or more of them may be used in combination and they may be also used in combination with other sensitizing dyes having different spectral sensitization region.

The double merocyanine sensitizing dyes used in the present invention can be synthesized by s-alkylating dimethine-rhodamerocyanine dyes (represented by the general formula II) with an alkylating agent (such as dimethyl sulfate) and then reacting the product in a suitable solvent (such as ethanol) with a rhodanine derivative in the presence of organic base (such as triethylamine).

General formula (II):

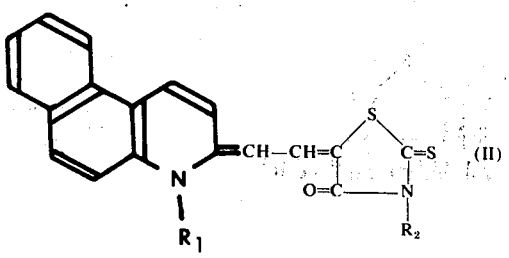

(II)

[wherein $R_1$ and $R_2$ are same as defined in general formula (I)].

Example of preparation of one of the double merocyanine sensitizing dyes used in the present invention is shown below:

1.95 Grams of 3-allyl-5-[3-(2-methoxyethyl)-2-(5,6-benzoquinolylidene)ethylidene] rhodanine was mixed with 2.84 g of dimethyl sulfate and the mixture was heated at 85° – 90°C for 1 hour. Then, the reaction product was cooled to room temperature and thereafter was sufficiently washed with ethyl ether. To the product was added 0.99 g of 3-ethoxycarbonylmethyl rhodanine (mentioned in "Yakugaku Zasshi (Journal of the Pharmaceutical Society of Japan)" Vol. 79, Page 1467) and these were dissolved in 80 ml of ethanol. Then, to the solution was added 2.28 g of triethylamine and refluxed for 30 minutes. After cooling to room temperature, precipitated crystal was filtered off, washed with ethanol and then acetone and thereafter recrystallized from about 100 ml of chloroform to obtain the compound No. 5 having a melting point of 282.0°C (decomposition) in a yield of 1.76 g.

Other sensitizing dyes of the present invention can also be prepared in accordance with said method.

Thus obtained sensitizing dye may be added to a photographic silver halide emulsion in the form of a solution in organic solvents freely miscible with water such as ethanol, acetone, dimethylformamide, etc. These sensitizing dyes may be added to the photographic silver halide emulsion at any time during preparation of the emulsion, but in general it is suitable to add them immediately after completion of digestion. Amount of the dyes added varies depending upon kind of silver halide, but preferably it is 0.3 mg – 100 mg per 1 kg of the silver halide emulsion. The amount, however, is not limited to said range and the larger or the smaller amount may also be employed. The sensitizing dyes of the present invention may be applied to any photographic silver halide emulsions such as silver chloride, silver bromide, silver chlorobromide, silver bromoiodide, etc. Furthermore, these emulsions may be subjected to sensitization with noble metal sensitizers, sulfur sensitizers, reduction sensitizers, polyalkylene oxide sensitizers, etc. Moreover, these emulsions may contain generally employed additives such as stabilizers, hardeners, surfactants, etc.

Other cyanine or merocyanine sensitizing dyes may be used in combination with the sensitizing dyes of the present invention to provide a higher spectral sensitivity depending upon the purpose of use. Thus, spectral sensitization of photosensitive materials which use various silver halides can be easily accomplished by the present invention.

The photographic silver halide photosensitive materials of the present invention can be obtained by coating a photographic emulsion containing the double merocyanine sensitizing dyes used in the present invention on a suitable support such as a glass, a triacetate base, a polyester base, paper, etc. and drying it.

The present invention will be illustrated in the following Examples.

EXAMPLE 1

The solubilities of the sensitizing dyes of the present invention in dimethylformamide at room temperature were examined. For comparison, solubility of a compound having the general formula (I) where $R_1$, $R_2$ and $R_3$ are all ethyl group (Compound No. 12) in dimethylformamide was also examined. The results are shown in Table 1.

Compound No. 12

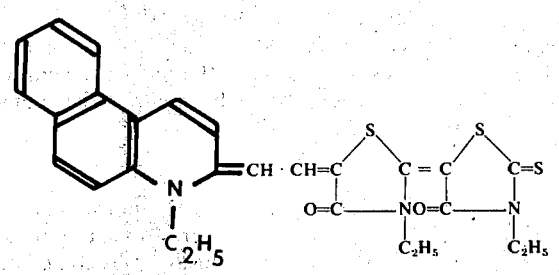

Table 1

| Compound | $R_1$ | $R_2$ | $R_3$ | Concentration of dyes and solubility 0.05 % | 0.03 % | 0.02 % |
|---|---|---|---|---|---|---|
| 12 | $-C_2H_5$ | $-C_2H_5$ | $-C_2H_5$ | x | x | o |
| 1 | " | $-CH_2CH=CH_2$ | $-CH_2CH=CH_2$ | o | o | o |
| 2 | " | $-CH(CH_3)_2$ | " | o | o | o |
| 3 | " | $-CH_2CO_2C_2H_5$ | $-CH_2CO_2C_2H_5$ | o | o | o |
| 4 | $-(CH_2)_2-OCH_3$ | $-CH_2CO_2C_2H_5$ | $-CH_2CH=CH_2$ | o | o | o |
| 5 | " | $-CH_2CH=CH_2$ | $-CH_2CO_2C_2H_5$ | o | o | o |
| 6 | $-(CH_2)_2-OCH(CH_3)_2$ | " | $-CH_2CH=CH_2$ | o | o | o |
| 7 | " | $-CH(CH_3)_2$ | 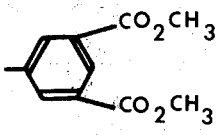 | o | o | o |
| 8 | " | " | $-CH_2CH=CH_2$ | o | o | o |
| 9 | " | $-CH_2CO_2C_2H_5$ | $-CH_2CO_2C_2H_5$ | o | o | o |
| 10 | $-(CH_2)_2-OCH_3$ | $-CH_2CH=CH_2$ | $-CH_2CH=CH_2$ | o | o | o |
| 11 | " | $-CH_2CO_2C_2H_5$ | $-CH_2CO_2C_2H_5$ | o | o | o |

The sensitizing dyes according to the present invention may be used not only in the common black and white photographic materials, but also in silver halide photosensitive materials of high contrast which are to be developed with lith type developer or color photographic photosensitive materials. In case of using in the lith type high contrast silver halide photosensitive materials, adjustment of developing speed can be accomplished more easily as compared with the conventional various sensitizing dyes. Furthermore, the present sensitizing dyes in color photographic photosensitive materials are excellent as red sensitizer.

In the above Table 1, "X" means that there remained undissolved dyes and "o" means that the dyes were completely dissolved.

As is clear from Table 1, the sensitizing dyes of the present invention had solubility of higher than 2.5 times that of the comparative compound No. 12.

EXAMPLE 2

A silver chlorobromide emulsion was prepared with 120 g of silver nitrate and equally divided into 6 portions, to each of which sensitizing dyes as shown in Table 2 and the usually employed stabilizers, hardeners, surfactants and the like were added. Each of the emulsion was coated on a film support and dried.

Each of the dried sample was contacted with D = 0.15 steps tablet and exposed through wratten filter No. 29. After developing the exposed samples, characteristics thereof were obtained. The results are shown in Table 2.

Table 2

| Sample No. | Sensitizing dyes added | Amount | Solvent: Dimethylformamide | Solvent: Acetone | Relative sensitivity | Fog |
|---|---|---|---|---|---|---|
| 1 | 12 | 5 mg | 30 cc | — | 100 | 0.16 |
| 2 | 1 | 5 mg | 1 cc | 29 cc | 100 | 0.04 |
| 3 | 4 | 5 mg | 1 cc | 29 cc | 112 | 0.05 |
| 4 | 9 | 5 mg | 1 cc | 29 cc | 85 | 0.03 |
| 5 | 10 | 5 mg | 1 cc | 29 cc | 100 | 0.05 |
| 6 | 11 | 5 mg | 1 cc | 29 cc | 91 | 0.03 |

In the above Table 2, in case of the comparative compound 12, only dimethylformamide was used as solvent in view of solubility. Regarding the sensitizing ability, the sensitizing dyes of the present invention are equal to or higher than the comparative compound. However, the sensitizing dyes of the present invention are extremely excellent than the comparative compound in fog.

EXAMPLE 3

In the same manner as in Example 2, emulsions were prepared and the sensitizing dyes were added thereto as shown in Table 3. Each of the emulsions was coated on the support and dried as in Example 2. The effects of combination with 1,1',3,3'-tetraethyl-5,5',6,6'-tetrachlorobenzimidazolocarbocyanineiodide (Compound No. 13) was compared after exposure and processing in the same manner as in Example 2.

Table 3

| Sample No. | Sensitizing dies (compound No.) | Amount | Amount of compound No. 13 | Relative sensitivity |
|---|---|---|---|---|
| 1 | 12 | 3 mg | — | 100 |
| 2 | 12 | 3 mg | 5 mg | 77 |
| 3 | 3 | 3 mg | — | 94 |
| 4 | 3 | 3 mg | 5 mg | 94 |
| 5 | 5 | 3 mg | — | 105 |
| 6 | 5 | 3 mg | 5 mg | 131 |
| 7 | 6 | 3 mg | — | 101 |
| 8 | 6 | 3 mg | 5 mg | 125 |
| 9 | 11 | 3 mg | — | 90 |
| 10 | 11 | 3 mg | 5 mg | 91 |

Combination of two or more of the same or different kind of dyes often causes reduction in sensitizing efficiency. In the above Table 3, the example of sample No. 2 is typical example of such case. On the other hand, in case of the sensitizing dyes of the present invention, substantially no reduction is caused and rather the sensitization efficiency was increased.

What is claimed is:

1. A photographic silver halide emulsion containing, as a sensitizing dye, at least one compound having the following general formula:

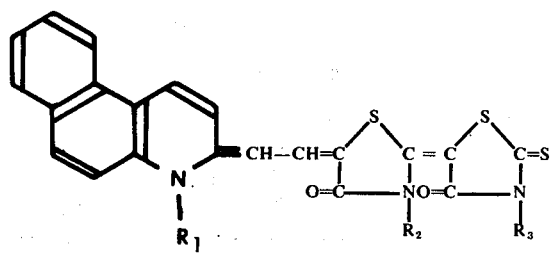

wherein $R_1$, $R_2$ and $R_3$ are selected from the group consisting of alkyl of not more than 5 carbon atoms, alkyl of not more than 5 carbon atoms substituted with alkoxy of not more than 5 carbon atoms, alkyl of not more than 5 carbon atoms substituted with alkoxycarbonyl of not more than 5 carbon atoms, dicarbomethoxyphenyl and allyl with the proviso that all of $R_1$, $R_2$ and $R_3$ cannot be alkyl at the same time.

2. A photographic silver halide emulsion according to claim 1, wherein said compound is selected from the group consisting of the following compounds:

Compound No. 1

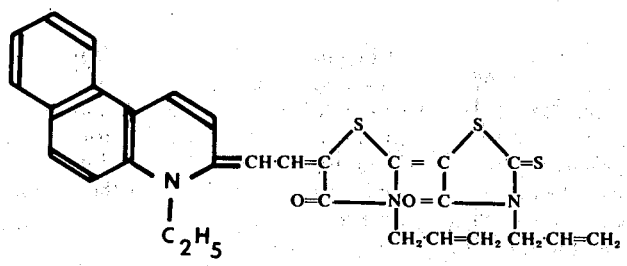

m.p. 275.0–6.5°C

Acetone absλ max 623.584 mμ

-continued
Compound No. 2
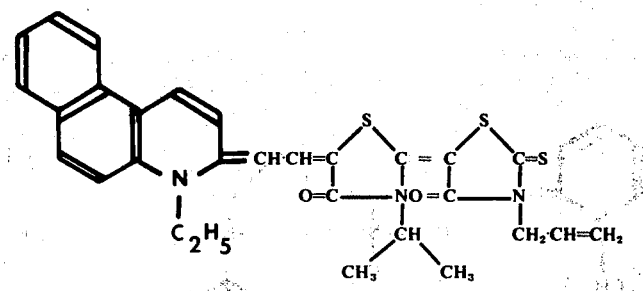
m.p. 259.0–262.0°C
Acetone absλ max 628.588 mμ
Compound No. 3
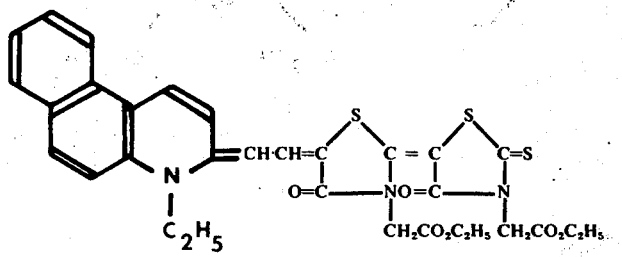
m.p. 274.0–5.0°C
Acetone absλ max 622.582 mμ
Compound No. 4
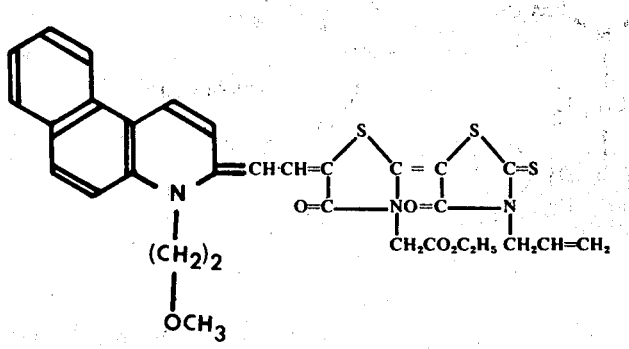
m.p. 276.0°C (dec)
Acetone absλ max 618.580 mμ
Compound No. 5
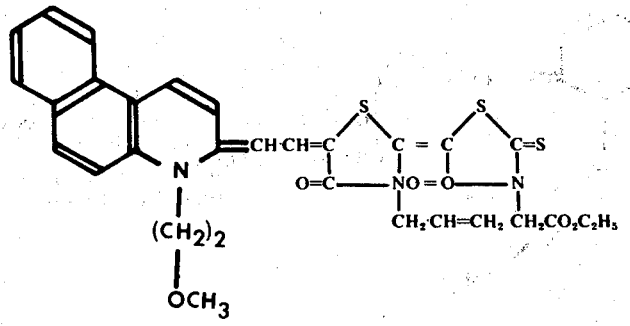
m.p. 282.0°C (dec)
Acetone absλ max 622.588 mμ
Compound No. 6
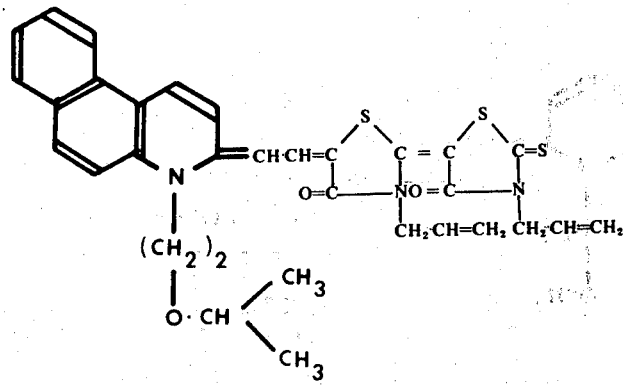
m.p. 231.0–3.0°C
Acetone absλ max 623.588 mμ

-continued
Compound No. 7
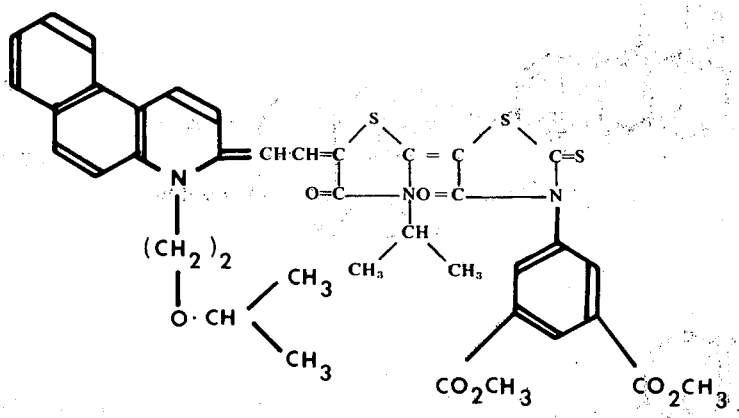
m.p. 278.0–280.0°C
Acetone absλ max 628.590 mμ
Compound No. 8
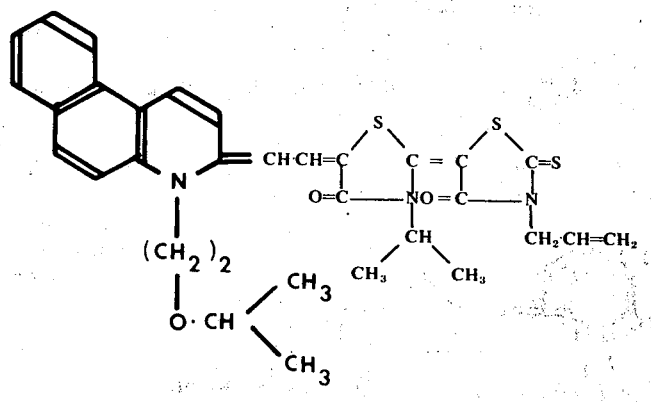
m.p. 276.0–7.0°C
Acetone absλ max 626.589 mμ
Compound No. 9
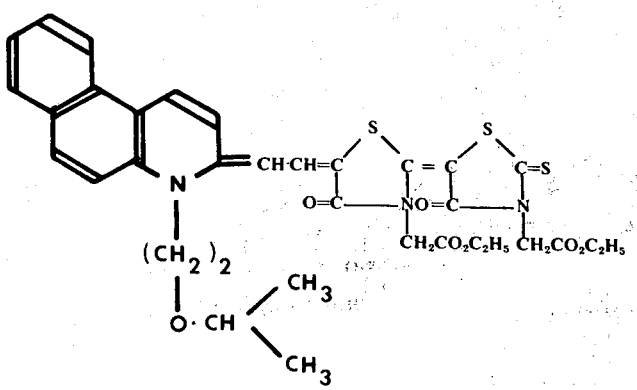
m.p. 239.0–240.0°C
Acetone absλ max 625.585 mμ
Compound No. 10
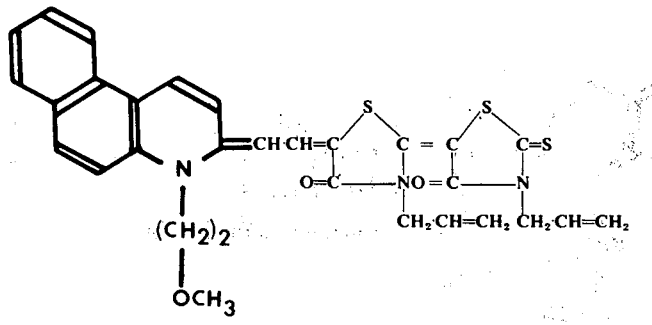
m.p. 281.0°C (dec)
Acetone absλ max 626.586 mμ

-continued

Compound No. 11

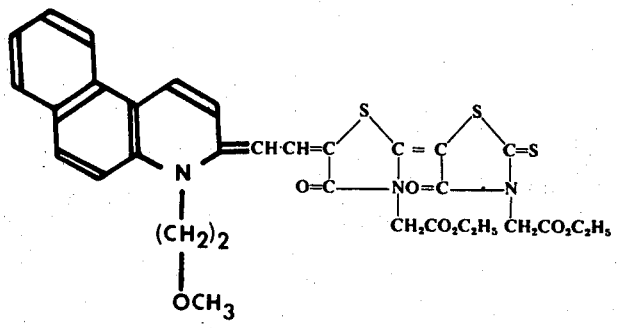

m.p. 281.0–3.0°C

Acetone absλ max 624.585 mμ

3. A photographic silver halide emulsion according to claim 1, wherein said sensitizing dye is contained in an amount of 0.3 mg – 100 mg per 1 kg of the silver halide emulsion.

4. A photographic silver halide photosensitive material comprising a support having coated thereon a photosensitive composition comprising a silver halide emulsion and the sensitizing dye as defined in claim 1.

5. In a sensitizing process where a sensitizing dye is added to silver halide emulsion, the improvement characterized in that at least one sensitizing dye as defined in claim 1 is added.

6. A photographic silver halide emulsion according to claim 1 wherein $R_1$ is alkyl of 1 to 5 carbon atoms or alkyl of 1 to 5 carbon atoms substituted with alkoxy of 1 to 5 carbon atoms, $R_2$ is alkyl of 1 to 5 carbon atoms, alkyl of 1 to 5 carbon atoms substituted with alkoxycarbonyl of not more than 5 carbon atoms or alkenyl and $R_3$ is alkyl of 1 to 5 carbon atoms, alkyl of 1 to 5 carbon atoms substituted with alkoxycarbonyl of not more than 5 carbon atoms, bis(carbomethoxy)phenyl or alkenyl.

7. A photographic silver halide emulsion according to claim 6 wherein $R_2$ is alkyl of 1 to 5 carbon atoms, allyl or methyl carbomethoxy, and $R_3$ is 1 to 5 carbon atoms alkyl, allyl methylcarboethoxy or bis(carbomethoxyl)phenyl.

8. A photographic silver halide emulsion according to claim 1 wherein it contains additionally 1,1',3,3'-tetraethyl-5,5',6,6'-tetrachlorobenzimidazolocarbocyanineiodide.

* * * * *